US011810711B2

(12) United States Patent
Bovier et al.

(10) Patent No.: US 11,810,711 B2
(45) Date of Patent: Nov. 7, 2023

(54) CRYOSTAT ASSEMBLY HAVING A RESILIENT, HEAT-CONDUCTING CONNECTION ELEMENT

(71) Applicant: Bruker Switzerland AG, Faellanden (CH)

(72) Inventors: Pierre-Alain Bovier, Zurich (CH); Robert Schauwecker, Zurich (CH); Guenter Kuebler, Egg (CH); Thomas Wuethrich, Greifensee (CH)

( * ) Notice: Subject to any disclaimer, the term of this patent is extended or adjusted under 35 U.S.C. 154(b) by 479 days.

(21) Appl. No.: 16/887,926

(22) Filed: May 29, 2020

(65) Prior Publication Data

US 2020/0411218 A1 Dec. 31, 2020

(30) Foreign Application Priority Data

Jun. 25, 2019 (DE) ..... 102019209160.1

(51) Int. Cl.
*H01F 6/04* (2006.01)
*F17C 13/00* (2006.01)
(Continued)

(52) U.S. Cl.
CPC ..... *H01F 6/04* (2013.01); *F17C 13/007* (2013.01); *H01F 6/06* (2013.01); *F17C 3/085* (2013.01);
(Continued)

(58) Field of Classification Search
CPC .. H01F 6/04; H01F 6/06; F17C 13/007; F17C 3/085; F17C 2203/0687; F17C 2223/0161;
(Continued)

(56) References Cited

U.S. PATENT DOCUMENTS 5,404,726 A * 4/1995 Janssen ..... F16L 35/00 62/297
5,744,959 A * 4/1998 Jeker ..... G01R 33/3815 62/51.1
(Continued)

FOREIGN PATENT DOCUMENTS

CN 106298152 A 1/2017
CN 107763432 A 3/2018
(Continued)

*Primary Examiner* — Miguel A Diaz
*Assistant Examiner* — Ibrahim A. Michael Adeniji
(74) *Attorney, Agent, or Firm* — BENOIT & COTE, INC.

(57) ABSTRACT

A cryostat assembly comprises an outer container that houses a coil tank with a superconducting magnet coil system and a first cryogenic fluid, and a storage tank with a second cryogenic fluid. The coil tank is secured to the outer container by a first suspension element and the storage tank is secured to the outer container by a second suspension element. The storage tank is thermally connected to a cover element having a mechanical and thermally-conductive connection to a tube element and to the first suspension element. The cover element connects to the storage tank via a resilient, heat-conducting connection that is in thermal contact with the cover element and the storage tank. This allows thermal coupling between the storage tank and cover element, and independent relative movements between the storage tank and cover element, while suppressing relative movements between the tube element and the superconducting magnet coil system.

17 Claims, 5 Drawing Sheets

(51) Int. Cl.
*H01F 6/06* (2006.01)
*F17C 3/08* (2006.01)
*F25D 19/00* (2006.01)

(52) U.S. Cl.
CPC ..... *F17C 2203/0687* (2013.01); *F17C 2223/0161* (2013.01); *F17C 2270/0536* (2013.01); *F25D 19/006* (2013.01)

(58) Field of Classification Search
CPC .... F17C 2270/0536; F17C 3/00; F17C 13/00; F17C 13/08; F17C 2223/0153; F25D 19/006; G01R 33/31
See application file for complete search history.

(56) References Cited

U.S. PATENT DOCUMENTS

| | | | |
|---|---|---|---|
| 5,966,944 | A | 10/1999 | Inoue |
| 6,617,853 | B2 | 9/2003 | Bovier et al. |
| 9,766,312 | B2 | 9/2017 | Grossniklaus et al. |
| 9,982,840 | B2 * | 5/2018 | Wikus ..... F17C 3/085 |
| 2007/0051115 | A1 | 3/2007 | Kraus et al. |
| 2007/0051116 | A1 | 3/2007 | Glemot et al. |
| 2008/0024254 | A1 | 1/2008 | Chiba et al. |
| 2009/0275477 | A1 | 11/2009 | Roth |
| 2018/0045796 | A1 * | 2/2018 | Schauwecker ..... G01R 33/30 |
| 2018/0051852 | A1 | 2/2018 | Wikus et al. |
| 2018/0120392 | A1 | 5/2018 | Laskaris et al. |
| 2020/0041176 | A1 * | 2/2020 | Wikus ..... G01R 33/3802 |

FOREIGN PATENT DOCUMENTS

| | | | |
|---|---|---|---|
| DE | 2906060 | A1 | 8/1979 |
| DE | 4039365 | A1 | 6/1992 |
| DE | 102014219849 | B3 | 12/2015 |
| EP | 0586947 | B1 | 1/1997 |
| EP | 1072899 | B1 | 10/2012 |
| GB | 2015716 | B | 12/1982 |
| JP | 2000037366 | A | 1/2006 |
| WO | 2017057760 | A1 | 4/2017 |

* cited by examiner

CRYOSTAT ASSEMBLY HAVING A RESILIENT, HEAT-CONDUCTING CONNECTION ELEMENT

BACKGROUND OF THE INVENTION

Field of the Invention

The invention relates to a cryostat assembly comprising an outer container in which a coil tank, having a superconducting magnet coil system to be cooled and a first cryogenic fluid, and a storage tank having a second cryogenic fluid are arranged, the temperature of the first cryogenic fluid being below that of the second cryogenic fluid at least in an operating state of the superconducting magnet coil system, the coil tank being mechanically rigidly secured to the outer container by means of at least one first suspension element and the storage tank being mechanically rigidly secured to the outer container by means of at least one second suspension element, the storage tank being thermally connected to a cover element which is thermally conductively and mechanically rigidly connected to a tube element and is thermally conductively and mechanically rigidly connected to the first suspension element via at least one coupling element.

Such a cryostat assembly has become known, for example, from U.S. Pat. No. 5,744,959 A.

Description of the Related Art

The present invention relates generally to the field of cooling superconducting magnet coil systems which are required to be maintained at very low (i.e., cryogenic) temperatures during operation. Magnet assemblies of this kind are used, for example, in the field of magnetic resonance, for example in MRI tomographs or NMR spectrometers. They are usually cooled with liquid helium as a first cryogenic fluid. For this purpose, they are housed in a cryostat that is operated using cryogenic liquids. The cryostat must be optimized such that the losses of cryogenic liquids are as low as possible. In order to reduce the consumption of expensive helium, the coil tank inside the cryostat is usually surrounded by a storage tank having a second, higher-boiling temperature cryogenic fluid, usually liquid nitrogen.

The design of a cryostat as a nested structure consisting of isothermal shells is described in DE 29 06 060 A1, for example. The innermost shell comprises a container (i.e., a "coil tank") having liquid helium for cooling a superconducting magnet; another shell contains a container (i.e., a "storage tank") having liquid nitrogen. The space inside the outermost container is evacuated. Such a cryostat is disclosed in U.S. Pat. No. 5,744,959 A, in which the cryostat contains a superconducting coil for NMR.

In U.S. Pat. No. 5,404,726 A, it is described that the coil tank is usually suspended from an outer container via thin steel tubes (i.e. "first suspension elements"). The same applies to the storage tank, which is suspended via "second suspension elements." Structures that are connected to the storage tank via heat conduction surround the entire coil tank and protect it from energy input by radiation. These structures comprise a base, a cover, and an inner tube. The coil tank and the outer container each also comprise an inner tube, so that a total of at least three inner tubes separate the room temperature bore from the superconducting magnet coil system.

In order to reduce the losses of liquid helium during operation, it is necessary to thermally couple the storage tank to the first suspension elements. For this purpose, contacting elements (i.e., "coupling elements") in the form of tubes are used, which elements are concentric with the first suspension elements and thermally connect the first suspension elements to the storage tank.

A rigid coupling of the storage tank to the first suspension elements would lead to mechanical over-determination and thus to uncontrollable movements of the coil tank if, for example, the second cryogenic fluid is refilled in the storage tank. To solve this problem, in U.S. Pat. No. 5,404,726 A the coupling elements described above are designed so as to be "mechanically soft" by means of slots. Apart from the coupling elements, there is no heat-conducting connection between the storage tank and the coil tank. In the embodiment of U.S. Pat. No. 5,404,726 A, the coil tank and the storage tank are thus mechanically largely decoupled from one another.

In particular, relative movements can occur between these two structures, for example in the case of vibrations. If the nitrogen inner tube (i.e., "tube element"), which moves synchronously with the storage tank, is displaced in the background field of the superconducting magnet, this leads to eddy currents in this tube according to Lenz's rule, which eddy currents change the magnetic field in the center of the magnet and lead to interference sidebands in the NMR spectrum.

Eddy currents in the tube element could be prevented by choosing a material with poorer electrical conductivity. However, materials having poor electrical conductivity generally also have poor thermal conductivity, which would result in an increase in the temperature of the tube element and thus in an increase in the loss of the first cryogenic fluid.

The tube element could also be slotted in the axial direction to prevent the eddy currents. However, this would mechanically weaken the tube element. Mechanical tensions could also be released during slotting, which would lead to undesirable deformations of the tube element. The close tolerances between the inner tubes of the cryostat assembly could then result in contact between two of these tubes, which would inevitably lead to an increase in the losses of cryogenic liquids.

Shim systems are often used to further improve the homogeneity of the magnetic field generated by the superconducting magnet coil system in NMR operation. Shims made of magnetic material are mostly in a room temperature range because they are then easily accessible and easily changed. However, shims made of magnetic material are also occasionally found in the coldest region of the magnet system, in particular in the coil tank in which the superconducting magnet coil system is accommodated, such as is described in U.S. Pat. No. 6,617,853 B2. Cold shims have the advantage of very stable magnetization, because on the one hand their temperature fluctuates little and on the other hand the magnetization of the material at low temperatures is practically independent of temperature. Magnetic material in rigid mechanical contact with the magnetic coils also does not move with respect to these coils, for example if the laboratory temperature changes, which results in very stable homogeneity in operation.

An elegant solution is described in U.S. Pat. No. 9,766,312 B2. It consists of attaching the magnetic material outside the coil tank in a region between the inner helium tube and the tube element. If the magnetic material is assembled only after the magnetic test, a complete disassembly of the cryostat becomes unnecessary. The advantages of cold magnetic material are retained. The region between the inner helium tube and the tube element remains difficult to access, however.

JP 2000037366 A describes a superconducting magnet system in which a field homogenization is generated using magnetic foils which are attached to a tube that is mechanically and thermally connected to a tank containing liquid nitrogen. Since the tank having the liquid nitrogen moves relative to the magnetic coils depending on its liquid level, the magnetic foils also move, which is associated with an instability of the homogeneity.

In U.S. Pat. No. 5,744,959 A, a cryostat assembly of the type in question comprising two tanks with different cryogenic fluids (coil tank with liquid helium, storage tank with liquid nitrogen) is described. However, the problem of thermal and mechanical coupling is not discussed in more detail there.

Due to the rigid mechanical connection between the storage tank and the nitrogen cover (i.e., "cover element") that is always present in the prior art, a "mechanical over-determination" of the system is generated, which leads to uncontrolled movements. This problem was recognized in U.S. Pat. No. 5,404,726 A cited above. However, the solution proposed there to mechanically decouple the coil tank from all structures at the temperature of the storage tank means that the tube element of the cryostat can move relative to the superconducting magnet coil system. In the event of vibrations, eddy currents are induced in this tube element and severely interfere with the NMR measurement by means of sidebands in the spectrum. The tube element is also not available as a carrier for shim elements, since movements of the shim elements relative to the superconducting magnet coil system would lead to an unstable homogeneity.

SUMMARY OF THE INVENTION

In contrast, the problem addressed by the present invention is that of improving a cryostat assembly of the type described at the outset, comprising a superconducting magnet coil system, using the simplest technical means possible so as to avoid the above-discussed disadvantages of known assemblies of the type in question. In particular, the invention seeks to provide an improved cryostat assembly, in which on the one hand good thermal coupling of the storage tank to the cover element is achieved, but on the other hand independent relative movements between the storage tank and the cover element are also made possible. The cover element should also be rigidly connected to the first suspension elements and to the tube element. In this way, relative movements between the tube element and the superconducting magnet coil system are suppressed. At the same time, the new cryostat assembly should be simple and reliable in design and inexpensive to manufacture.

This problem—which, when viewed in detail, is relatively challenging and complex—is solved by the present invention in a surprisingly simple and effective way, in that, in a cryostat assembly of the type defined at the outset, the cover element is mechanically connected to the storage tank via a resilient—and thus vibration-absorbing or at least vibration-damping—connection element which is also heat-conducting, the connection element being in thermal contact with both the cover element and the storage tank.

The present invention is primarily concerned with mechanically connecting the tube element of the cryostat to the coil tank as rigidly as possible, so that relative movements of the two structures can be prevented. This measure suppresses eddy currents in the tube element, which is a great advantage for magnets for nuclear magnetic resonance. In addition, the tube element is then suitable as a carrier for a shim made of magnetic material or for an electric shim.

This goal is achieved according to the invention by means of a rigid mechanical connection of the cover element to the first suspension elements and a rigid mechanical connection of the tube element to the cover element. In return, however, the mechanical connection of the cover element to the storage tank is made soft in order to allow independent movements of the latter. However, the thermal connection between these two structures must be maintained, for example by using copper strands or corrugated bellows as resilient connection elements.

The main function of the cover element and the tube element is to protect the coil tank from the radiation from the outer container. Since the radiation energy is proportional to the fourth power of the temperature, a temperature as low as possible of the cover element and tube element is very important in order to keep the losses of cryogenic liquid from the coil tank low. A good heat-conducting connection to the storage tank transfers its temperature to these elements.

Furthermore, the thermal connection of the cover element to the first suspension elements via the coupling element brings about a low temperature of the first suspension elements at the contact point. Due to this low temperature, the temperature gradient and thus also the heat input into the coil tank via the first suspension elements is small.

Furthermore, the rigid mechanical connection between the cover element and the first suspension element, as well as between the tube element and the cover element, which is required to effectively suppress relative movements between the tube element and the superconducting magnet coil system, is also maintained.

However, at the connection point between the cover element and the storage tank with the new connection element, which still conducts heat well but is resilient, a locally "mechanically soft" connection is created, which prevents the mechanical over-determination of the system that would otherwise be produced (at least in the case of all previously known assemblies). In this way, uncontrollable spatial displacements between the individual parts of the thermal line chain and thus thermal short circuits can be prevented effectively.

The following advantages, in particular, are achieved with the present invention:

In actively cooled systems, the vibrations of the cooler, especially in the case of a cooler for the storage tank, are transmitted to the tube element in a much weaker manner, so that almost no eddy currents are induced there. In spectroscopic applications, the interference sidebands in the spectrum are therefore strongly suppressed.

A similar advantage arises in the case of floor vibrations, since the tube element vibrates in phase with the superconducting magnet and not in phase with the storage tank, as in the prior art. Relative movements between the tube element and the superconducting magnet are thus largely eliminated.

Due to its rigid connection to the coil tank, the tube element is suitable as a carrier element for shims, by means of which the field homogeneity of the magnet can be improved.

In most applications, the first cryogenic fluid will be helium, and the second cryogenic fluid will be nitrogen, as mentioned multiple times above.

The outer container is usually designed as a vacuum container and will be evacuated, at least in the NMR operating state of the superconducting magnet coil system, in the regions between the coil tank and the storage tank in order to ensure the highest possible thermal insulation between the components within the outer container.

Most particularly preferred is an embodiment of the cryostat assembly according to the invention in which the connection element comprises a corrugated bellows, strands or fabric made of thermally conductive material with a thermal conductivity of >100 W/mK, preferably made of copper or aluminum. The strands, which form a loose mechanical connection, serve the purpose of mechanical decoupling without having to sacrifice the thermal connection.

Embodiments of the invention in which the connection element transmits only a force of 100 N/mm to the cover element when the storage tank is displaced are also advantageous. In the operating state, the greatest displacements of the storage tank occur when it is filled with its cryogenic liquid. In vertical systems, the storage tank is typically displaced by a few tenths of a millimeter, which corresponds to a force transfer of at most a few 10 N onto the cover. Such a small force can only insignificantly displace the cover element due to the rigid connection of the cover element to the first suspension element.

Further advantageous embodiments of the invention are characterized in that a flange element is present for both the thermal and the rigid mechanical connection of the cover element to the tube element, said flange element consisting of a material that contracts more than the material of the tube element when the cryostat assembly is cooled from room temperature to an operating temperature. The connection between the cover element and the tube element should be particularly good both thermally and mechanically. If the tube element is inserted into the flange at room temperature, it will be clamped at the operating temperature, which ensures both good thermal and good mechanical contact if both materials have good thermal conductivity.

Also advantageous are embodiments of the cryostat assembly according to the invention which are characterized in that a flange element is present for both the thermal and the mechanical rigid connection of the cover element to the tube element, which flange element is both screwed to the cover element and soldered or welded to the tube element. With such an assembly, good thermal and good mechanical contact are also ensured.

In preferred developments of these embodiments, the tube element is made of copper and the flange element is made of aluminum. Since aluminum contracts more than copper when it cools down, both good thermal contact and good mechanical contact are achieved in the operating state.

A class of embodiments of the invention is characterized in that the storage tank is thermally connected to the tube element via both the cover element and a base element. This double connection allows the temperature of the tube element to be brought closer to the temperature of the storage tank via heat conduction. In addition, the base element ensures that the outer container cannot radiate directly onto the coil tank.

In preferred developments of this class of embodiments, the base element is mechanically connected to the storage tank via a further resilient, heat-conducting connection element, preferably with a spring constant of ≤100 N/mm. This effectively avoids the movements of the storage tanks from being transmitted to the tube element.

Other developments are characterized in that the base element is mechanically flexible and preferably has slots extending radially with respect to a room temperature bore in the cryostat assembly. The mechanical weakening of the base element ensures that movements of the storage tank are only partially transferred to the tube element. Due to the radial design of the slots, the heat conduction between the storage tank and the tube element is influenced only insignificantly.

Very particularly advantageous is a class of embodiments of the invention in which a shim system for homogenizing the magnetic field generated by the superconducting magnet coil system is present, said shim system comprising shim elements made of magnetic material and/or electrical shim elements. In NMR applications, the field homogeneity specifications are so strict that they can only be achieved using shim elements. The field profile is usually recorded in the measurement volume and the necessary shim currents or the geometry of magnetic shim elements are determined from this using a numerical method.

Developments of this class of embodiments in which shim elements are attached to the tube element radially on the inside or the outside are favorable. In the known prior art, MRI magnets are typically homogenized exclusively using room temperature shims made of magnetic material, while in spectroscopy cryoshims are usually used in the coil tank and warm electrical shims are usually used at room temperature. The warm electrical or magnetic shims occasionally lead to fluctuating homogeneity when the temperature or pressure in the laboratory varies. One reason for this is a relative movement between these shim elements and the superconducting magnet coil system. Due to the mechanical decoupling from the storage tank, the invention now also allows certain shim elements to be placed in the cooled interior of the cryostat assembly, in particular with the tube element as a carrier. Neither temperature and pressure fluctuations in the laboratory nor movements of the storage tank when it is being filled with its cryogenic liquid influence the position of the tube element and thus also the position of the shim elements placed there. This leads to a very stable homogeneity.

If an electric shim is attached to the tube element, there is the advantage of a variable shim strength compared to the shim with magnetic material, since the current through the electric shim can be variably adjusted. Due to the low temperature of the electrical shim arranged in the cooled interior of the cryostat assembly, the electrical resistance of said shim is typically less than in the case of room temperature shims by a factor of 10, which allows the feeding of currents which are at least three times larger, and can therefore generate much higher magnetic fields.

It is also advantageous for the electrical shim elements to be made of copper, because copper has a high electrical conductivity. This reduces the heat generated by the current-carrying conductor.

Particularly preferable are also embodiments of the invention in which at least one radiation shield is provided between the storage tank and the coil tank, said radiation shield, in an operating state of the magnet coil system, having a temperature between that of the first cryogenic fluid and that of the second cryogenic fluid. An essential requirement for a radiation shield is that it is as isothermal as possible. This usually requires that the radiation shield be made of a material with good thermal conductivity, and that the geometry of the radiation shield be selected such that from each point of the radiation shield, good heat transfer is possible to the point where the radiation shield is connected to a "heat sink."

In further preferred embodiments of the cryostat assembly according to the invention, at least one cryocooler is present in the cryostat assembly for reducing the consumption of the first and/or the second cryogenic fluid. Cryocoolers generate vibrations that are transferred to the various components of the cryostat. However, the invention ensures that the tube element and the coil tank vibrate synchronously and thus eddy currents in the tube element are suppressed.

The present invention can be used with particular advantage if a room temperature bore having a vertical or horizontal axis is present in the cryostat assembly and the cryostat assembly is part of an NMR apparatus for spectroscopy or imaging. Horizontal magnet bores are especially favorable precisely for MRI systems, since the object to be examined (e.g. a human or an animal) can then be placed horizontally in the test chamber in the magnet center. In systems for spectroscopy where predominantly liquids are analyzed, vertical magnet bores are often used to ensure that the liquid surface is not within the sample volume.

The space within the bore is very limited, since in addition to the tube element, which is thermally conductively connected to the storage tank, the inner tube of the coil tank and the inner tube of the outer container must also be accommodated. These inner tubes should take up as little space as possible from the superconducting magnet coil system. However, contact between inner tubes must be avoided at all costs. In the case of vertical magnet bores, the gravitational vector is parallel to the axis of the bore, i.e. deformations due to its own weight usually do not lead to contact of the components (radiation shields, etc.) within the bore. This is not the case with horizontal bore systems, which is why the coil tank suspensions need to be particularly tight on horizontal bore systems.

Further advantages of the invention can be found in the description and the drawings. Likewise, according to the invention, the features that are mentioned above and set out in the following can each be used individually per se or together in any combinations. The embodiments shown and described are not to be understood as an exhaustive list, but instead are of an exemplary nature for describing the invention.

BRIEF DESCRIPTION OF THE DRAWINGS

The invention is illustrated in the drawings and is explained in more detail with reference to embodiments. In the drawings.

DETAILED DESCRIPTION

Figure 1:
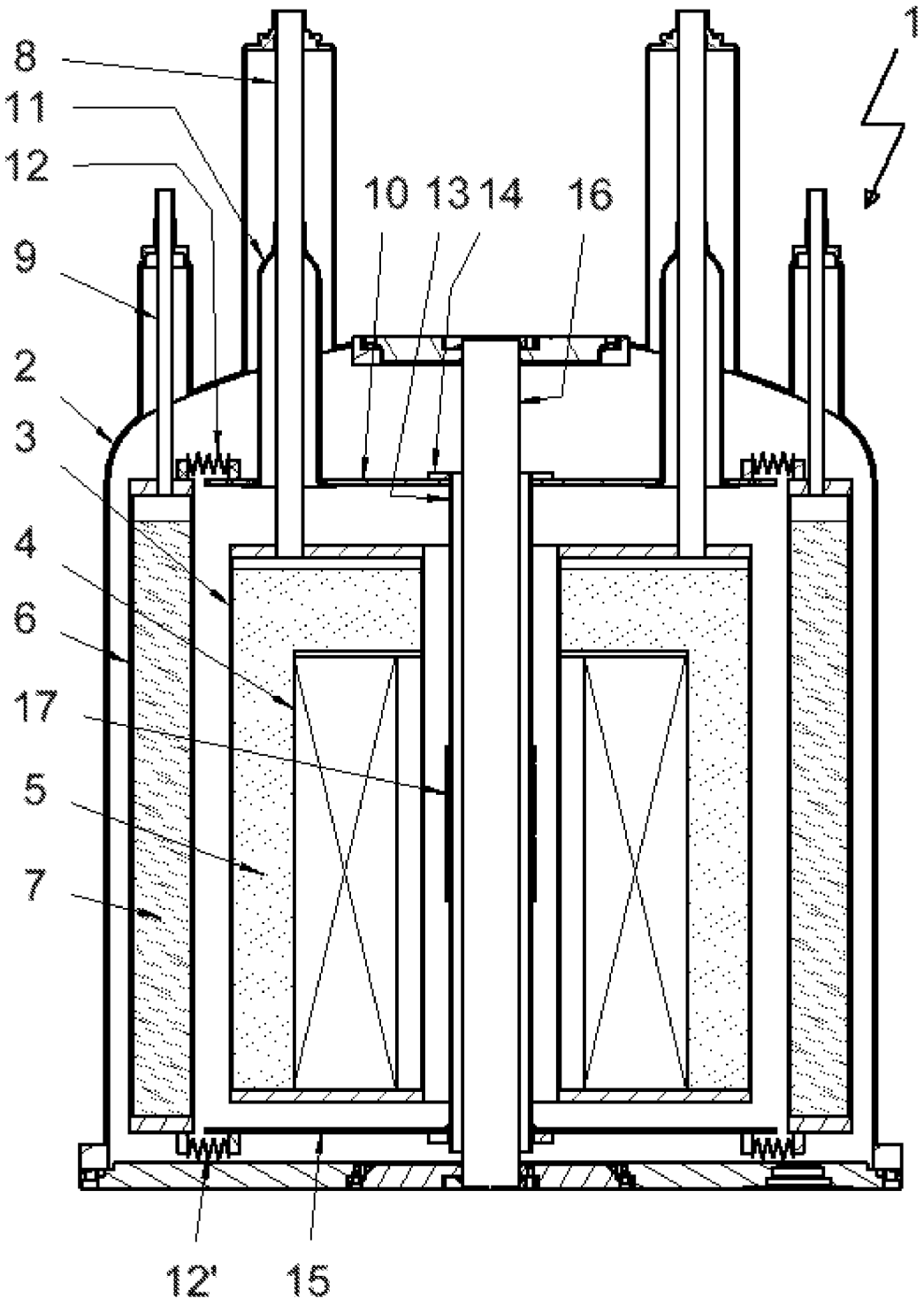
FIG. 1 is a schematic vertical sectional view of an embodiment of the cryostat assembly according to the invention.
Figure 2:
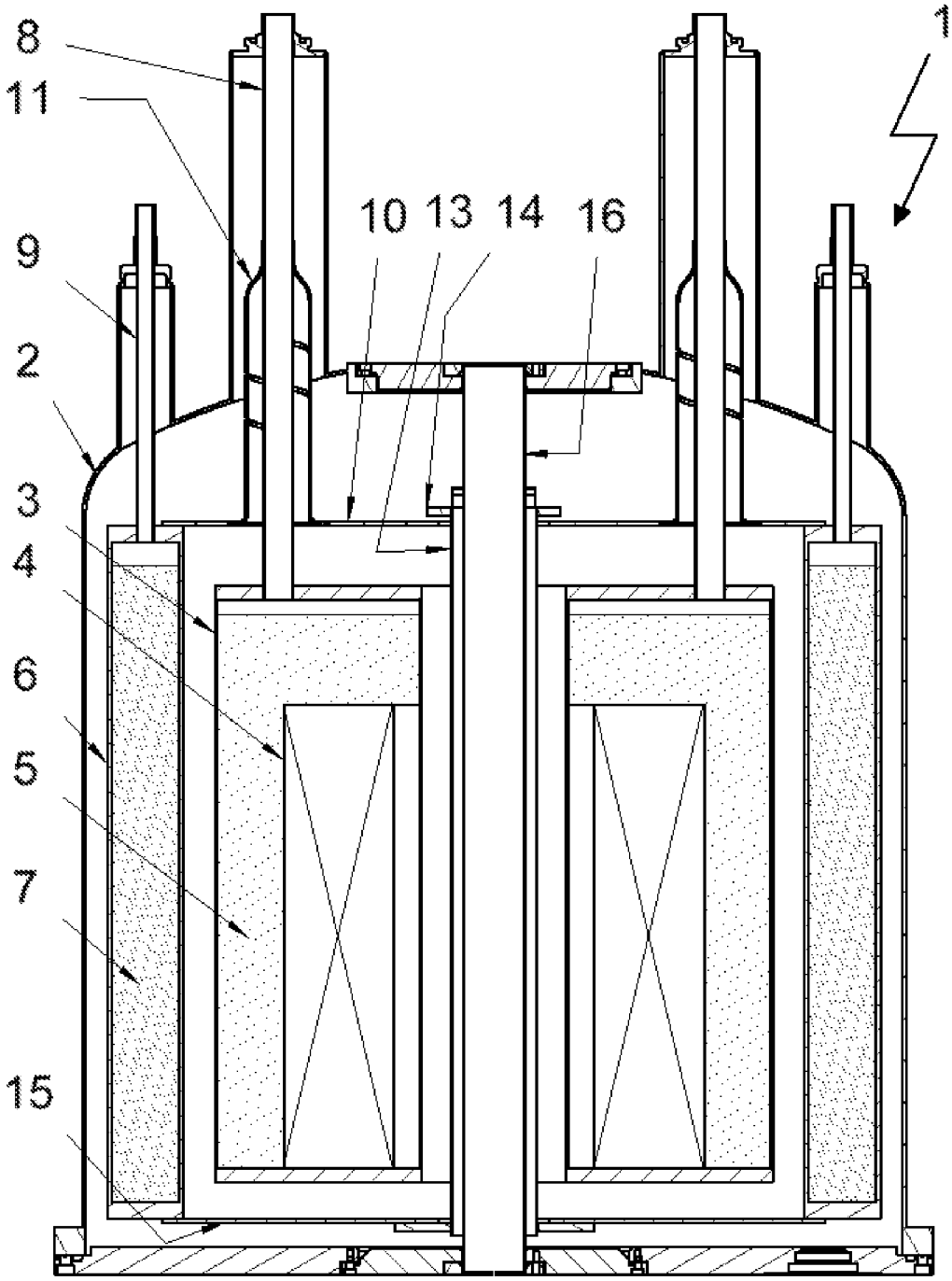
FIGURE 2 (PRIOR ART)
FIG. 2 is a vertical sectional view of a cryostat assembly according to the prior art.
Figure 3:
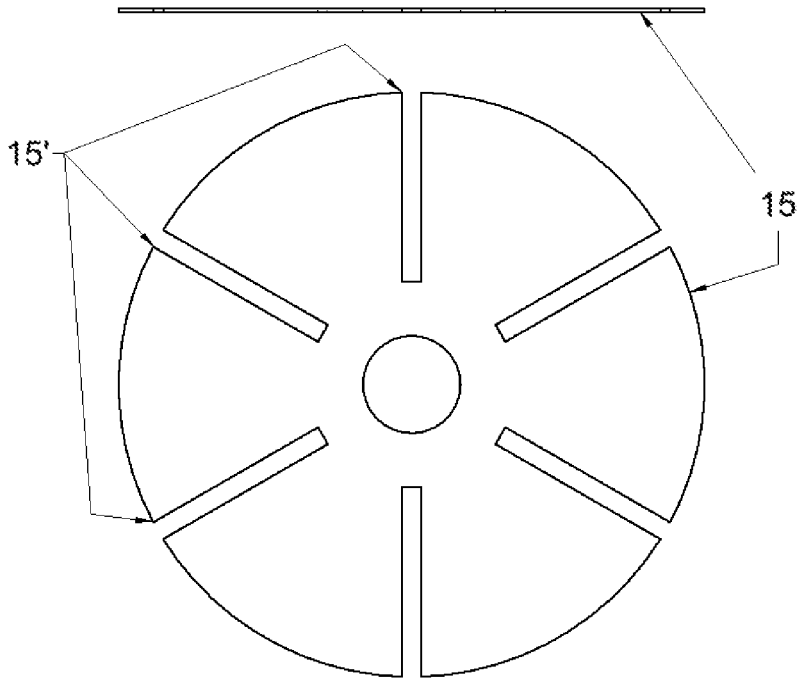
FIG. 3 is a schematic detailed view of the slotted base element from the side and from below.

FIGS. 1 and 3-6 of the drawings are each schematic views showing different details of preferred embodiments of the cryostat assembly according to the invention for cooling a superconducting magnet assembly, while FIG. 2 shows a generic cryostat assembly according to the closest prior art.

A cryostat assembly 1 of this kind comprises an outer container 2 in which a coil tank 3, having a superconducting magnet coil system 4 to be cooled and a first cryogenic fluid 5, is arranged. The superconducting magnet coil system 4 is also cooled, at least in an operating state, by a second cryogenic fluid 7 located in a storage tank 6, the temperature of which fluid is above that of the first cryogenic fluid 5. The coil tank 3 is mechanically rigidly secured to the outer container 2 by means of at least one first suspension element 8 and the storage tank 6 is mechanically rigidly secured to the outer container 2 by means of at least one second suspension element 9. In addition, the storage tank 6 is thermally connected to a cover element 10 which is, via at least one coupling element 11, thermally conductively and mechanically rigidly connected to the first suspension element 8 and thermally conductively and mechanically rigidly connected to a tube element 13.

Liquid helium, which has a lower operating temperature than the second cryogenic fluid—usually liquid nitrogen—is generally used as the first cryogenic fluid. The outer container 2 will normally be designed as a vacuum container.

In order to generate high magnetic fields or to reduce the volume of superconducting magnet coil systems, it is often advantageous to subcool the liquid helium, since this increases the critical current density of the superconductor. The subcooling takes place either by generating a vacuum in the coil tank or by using a subcooling unit as described in DE 40 39 365 A1, for example. In particular, it may be the case that a further storage tank having, for example, liquid helium at normal pressure is provided. The present invention is also advantageous for such cryostat assemblies.

The present invention broadens this per se known assembly by the following essential elements of the invention: The cryostat assembly 1 according to the invention is distinguished from the devices from the prior art in that the cover element 10 is mechanically connected to the storage tank 6 via a resilient, heat-conducting connection element 12, the connection element 12 being in thermal contact with both the cover element 10 and the storage tank 6.

In embodiments of the invention—as can be clearly seen in FIG. 1—a flange element 14 can be present, which is used for both the thermal and the rigid mechanical connection of the cover element 10 to the tube element 13. The flange element 14 may be made of a material which contracts more than the material of the tube element 13 when the cryostat assembly 1 is cooled from room temperature to an operating temperature. For example, the tube element 13 can be made of copper and the flange element 14 can be made of aluminum. The flange element 14 can also be both screwed to the cover element 10 and soldered or welded to the tube element 13.

As also shown in FIG. 1, the storage tank 6 can be thermally connected to the tube element 13 via both the cover element 10 and a base element 15. This base element 15 can in turn be mechanically connected to the storage tank 6 via a further resilient, heat-conductive connection element 12', preferably with a spring constant of 100 N/mm.

The base element 15 will preferably be mechanically flexible. In further developments, this can be achieved in that it has radially extending slots 15' with respect to a room temperature bore 16 of the cryostat assembly 1. This is shown schematically in FIG. 3.

Figure 4:
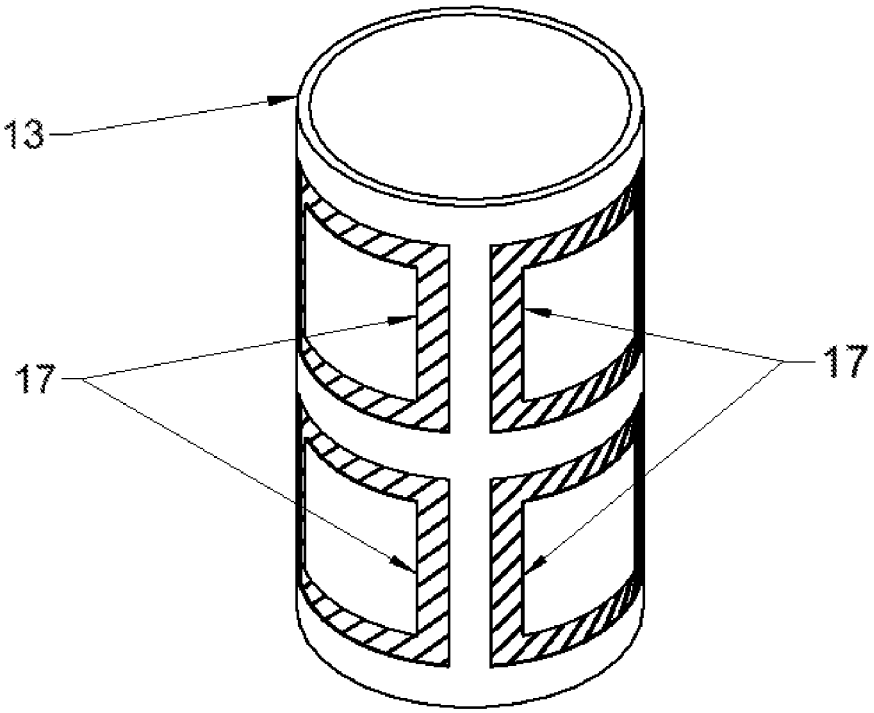
FIG. 4 is a schematic detailed view of the tube element with electrical shim elements applied thereon.

Details of another embodiment are shown in FIG. 4. Here, a shim system for homogenizing the magnetic field generated by the superconducting magnet coil system 4 is present, said shim system comprising shim elements 17 made of magnetic material and/or electrical shim elements 17. The shim elements 17 can be attached to the tube element 13 radially on the inside or the outside. In the case of electrical shim elements 17, these will be made of copper and will be applied, for example in the form of loop-shaped electrical coils, to the outer circumference of the tube element 13.

Figure 5:
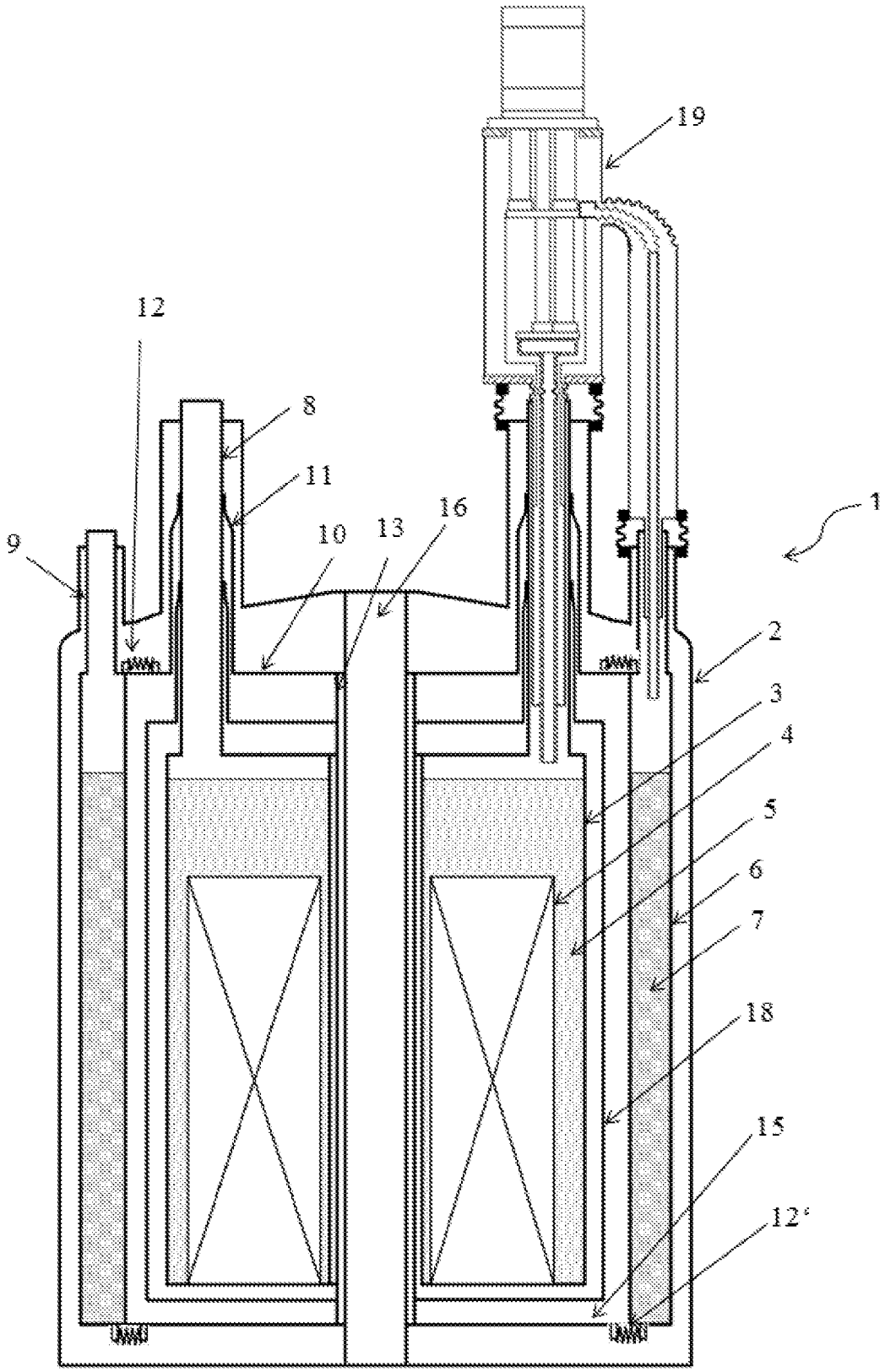
FIG. 5 is a schematic vertical sectional view of an embodiment of the cryostat assembly according to the invention having a cryocooler.

FIG. 5 also shows an embodiment in which at least one radiation shield 18 is provided between the storage tank 6 and the coil tank 3, said radiation shield, in an operating state of the superconducting magnet coil system 4, having a temperature between that of the first cryogenic fluid and that of the second cryogenic fluid.

Additionally, this drawing also shows an active cooler in the form of a cryocooler 19 for reducing the consumption of the first cryogenic fluid and/or the second cryogenic fluid in the cryostat assembly 1. In the case of NMR magnets, a low-vibration pulse tube cooler can be used, for example.

Figure 6:
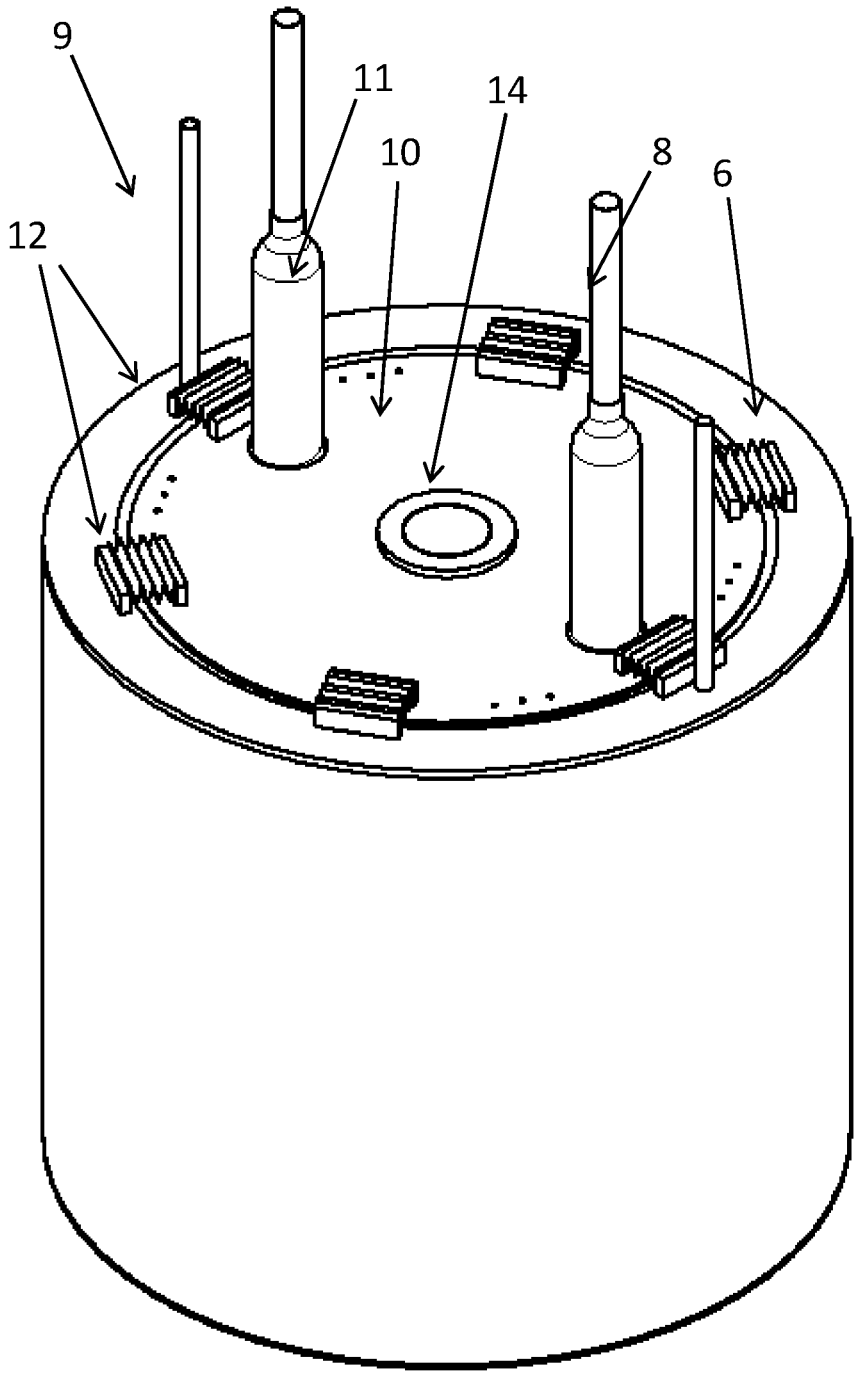
FIG. 6 is an isometric view of the storage tank, which is connected to the cover element via resilient, heat-conducting connection elements.

Finally, FIG. 6 is an isometric view of the storage tank 6, which is connected to the cover element 10 via resilient, heat-conducting connection elements 12. These connection elements are shown here as corrugated bellows. In another embodiment, strands, preferably made of copper, are used.

The features of all the above-described embodiments of the invention may also be combined with one another at least in most cases.

The invention claimed is:

1. A cryostat assembly comprising:

an outer container;

a coil tank located in the outer container and being secured thereto by a first suspension element, the coil tank containing a superconducting magnet coil system to be cooled and a first cryogenic fluid;

a storage tank located in the outer container and being secured thereto by a second suspension element, the storage tank containing a second cryogenic fluid having a temperature higher than that of the first cryogenic fluid during operation of the magnet coil system;

a tube element located within the outer container that surrounds a room temperature bore; and a cover element that is substantially fixed to the tube element and to the first suspension element by substantially thermally conductive connections such that relative movements between the tube element and the coil tank are prevented, and that is connected to the storage tank via a connection element that is substantially thermally conductive and that provides a substantially mechanically decoupled connection that enables relative movement between the cover element and the storage tank.

2. A cryostat assembly according to claim 1, wherein the connection element comprises a corrugated bellows, strands, or fabric made of thermally conductive material with a thermal conductivity of >100 W/mK.

3. A cryostat assembly according to claim 1, wherein the connection element transmits a force of ≤100 N/mm to the cover element when the storage tank is displaced.

4. A cryostat assembly according to claim 1, further comprising a flange element that provides a thermal and mechanical connection between the cover element and the tube element, said flange element consisting of a material that contracts more than a material of the tube element when the cryostat assembly is cooled.

5. A cryostat assembly according to claim 4, wherein the tube element is made of copper and the flange element is made of aluminum.

6. A cryostat assembly according to claim 4, wherein the flange element is screwed to the cover element and soldered or welded to the tube element.

7. A cryostat assembly according to claim 1, wherein the storage tank is thermally connected to the tube element via the cover element and via a base element located to an opposite side of the superconducting magnet coil system from the cover element.

8. A cryostat assembly according to claim 7, wherein the connection element is a first connection element, and wherein the base element is connected to the storage tank via a second connection element that is substantially thermally conductive and that provides a substantially mechanically decoupled connection that enables relative movement between the base element and the storage tank.

9. A cryostat assembly according to claim 7, wherein the base element is mechanically flexible and has slots extending radially with respect to the room temperature bore.

10. A cryostat assembly according to claim 1, further comprising a shim system for homogenizing the magnetic field generated by the magnet coil system.

11. A cryostat assembly according to claim 10, wherein the shim elements are radially attached to the tube element.

12. A cryostat assembly according to claim 10 wherein the shim system comprises shim elements of a magnetic material.

13. A cryostat assembly according to claim 10 wherein the shim system comprises electrical shim elements.

14. A cryostat assembly according to claim 13, wherein the electrical shim elements are made of copper.

15. A cryostat assembly according to claim 1, further comprising at least one radiation shield located between the storage tank and the coil tank which, during operation of the superconducting magnet coil system, has a temperature between that of the first cryogenic fluid and that of the second cryogenic fluid.

16. A cryostat assembly according to claim 1, wherein at least one cryocooler is present in the cryostat assembly for reducing consumption of the first and/or the second cryogenic fluid.

17. A cryostat assembly according to claim 1, wherein the cryostat assembly is part of an NMR apparatus for spectroscopy or imaging.

* * * * *